United States Patent [19]

Mayfield et al.

[11] 4,377,304

[45] Mar. 22, 1983

[54] DOOR LOCK

[75] Inventors: Charles W. Mayfield; Oliver J. Jenkins, both of Youngstown, Ohio

[73] Assignee: Youngstown Steel Door Company, Cleveland, Ohio

[21] Appl. No.: 193,903

[22] Filed: Oct. 6, 1980

[51] Int. Cl.[3] ..... E05C 13/02; E05C 19/08

[52] U.S. Cl. ..... 292/283; 292/DIG. 32

[58] Field of Search ..... 292/205, 218, 283, 284, 292/286, 66, DIG. 32; 49/276, 277, 278, 449

[56] References Cited

U.S. PATENT DOCUMENTS

| | | | |
|---|---|---|---|
| 777,738 | 12/1904 | Lerch | 292/284 |
| 1,148,143 | 7/1915 | Brooks | 292/284 |
| 1,390,306 | 9/1921 | Mayhew | 292/284 |
| 1,507,593 | 9/1924 | Galloway | 292/286 |
| 1,571,159 | 1/1926 | Posson | 49/277 X |
| 1,877,263 | 9/1932 | Beauchamp | 292/283 |
| 1,883,165 | 10/1932 | Vegren | 49/277 X |
| 1,976,913 | 10/1934 | Beauchamp | 292/283 |
| 2,392,906 | 1/1946 | Doyle | 292/283 |
| 2,788,995 | 4/1957 | Madland | 292/283 |
| 3,279,839 | 10/1966 | Madland | 292/284 |
| 4,162,591 | 7/1979 | Madland et al. | 292/DIG. 32 X |

*Primary Examiner*—Thomas J. Holko

*Attorney, Agent, or Firm*—Fay & Sharpe

[57] ABSTRACT

A door lock includes a cooperating bracket and hasp having aligned openings for receiving a pin. In the locking position of the pin, in which the pin is received through the aligned openings, a transverse hole in the lower end portion of the pin is aligned with a vertically elongated slot in a wall of the bracket for receiving a security member to prevent upward movement of the pin out of the openings. The openings are shaped to have aligned outwardly extending longitudinal grooves which receive a longitudinal flange on the pin. A cam member pivots between pin blocking and pin releasing positions and has a flat lower flange with a vertical hole therethrough. The hasp has a flat upper wall with a hole therethrough aligned with the hole in the cam member lower flange for receiving a security member to prevent movement of the cam member from its pin blocking position to its pin releasing position.

7 Claims, 15 Drawing Figures

DOOR LOCK

BACKGROUND OF THE INVENTION

This application relates to the art of locks and, more particularly, to locks for securing a sliding door in a closed position. The invention is particularly adapted for use on railway box car doors which are mounted for sliding or rolling movement along a door track.

The door lock of the present application involves certain improvements to the door lock disclosed in U.S. Pat. No. 3,279,839 to Madland issued Oct. 18, 1966, the disclosure of which is incorporated hereinto by reference.

The door lock described in the foregoing U.S. Pat. No. 3,279,839 includes a bracket secured to a door jamb or to an upright edge portion on a secured auxiliary door of a double sliding door arrangement. The bracket includes vertically-spaced upper and lower sleeves with substantially vertical aligned upper and lower openings therethrough. A hasp is movably attached to a movable door and includes a sleeve portion with an opening therethrough. The hasp is positionable so that its sleeve portion is located between the bracket upper and lower sleeves with the hasp opening substantially vertically aligned relative to the bracket upper and lower openings in the upper and lower sleeves. A pin extends through the aligned openings for releasably securing the hasp against movement relative to the bracket.

In the lock assembly described in U.S. Pat. No. 3,279,839, the bottom end of the pin extends a substantial distance downwardly past the bottom edge of the lower sleeve. The bottom end portion of the pin has a circular hole or opening therethrough for receiving a security member, such as the wire loop of a padlock or the like. Instead of placing a rigid wire loop of a padlock or the like through the hole in the bottom end portion of the pin, it has been found that a relatively small and flexible shipper's seal is often passed through the hole in the pin. In view of the fact that such a seal extends through the hole in the pin only and not through any part of the bracket, it is often possible to deform and manipulate the shipper's seal for passing same upwardly along with the pin through the openings in the sleeves and hasp. This then allows unauthorized persons to enter the car without damaging the shipper's seal and subsequent replacement of the pin with the seal intact provides no warning or indication that the car has been entered.

The door lock disclosed in the foregoing patent also includes a pivoted cam member having a projection extending into a vertical groove included in the pin. A shoulder at the bottom of the groove cooperates with the cam member projection for preventing upward displacement of the pin through the hasp opening unless the cam member is pivoted outwardly for displacing the projection from the groove. The cam member has a curved bottom flange disposed opposite an upper wall portion of the hasp. Relatively small aligned holes through the cam member curved bottom flange and the hasp upper wall are sized for receiving a shipper's seal. This provides minimal extra security because the shipper's seal is easily broken for allowing outward pivotal movement of the cam member to displace the cam member projection from the pin groove and thereby allow displacement of the hasp away from the bracket so that the door can be opened. Due to the curved bottom flange on the cam member, it is sometimes difficult to align the hole therein with the hole in the hasp upper wall.

The lock described in the U.S. Pat. No. 3,279,839 has a pivoted lever cooperative with the hasp through a cooperating connection for moving the hasp generally longitudinally in response to pivoting movement of the lever for accomplishing initial opening movement or final closing movement of the door to which the hasp is attached. The cooperating holes in the hasp upper wall and cam member bottom flange are located intermediate the sleeves and the lever-to-hasp connection. This is a crowded area for a padlock or the like, and it has been found more desirable to locate such holes on the opposite side of the lever-to-hasp connection from the sleeves.

In the lock of the U.S. Pat. No. 3,279,839, the pin receiving openings in the hasp and sleeves are rectangular and the pin has a rather large cross-section to closely occupy the openings while providing a pin front wall which is wide enough to have a transverse hole for receiving a padlock wire or the like without unduly weakening the pin front wall around the hole.

In view of the foregoing circumstances, it has been considered generally desirable to have a lock of the type generally described in the U.S. Pat. No. 3,279,839 arranged in such a manner that a shipper's seal attached to the pin could not be moved upwardly with the pin without breaking the seal. Moreover, it is also considered desirable to make it possible to use a heavy wire loop of a padlock through the cam member flange and upper wall of the hasp. It is further considered desirable to revise the shape of the hasp and sleeve openings to allow reception of a wide pin front wall while reducing the width of the pin rear wall. The subject invention meets these needs and others to provide an improved door lock structure.

BRIEF SUMMARY OF THE INVENTION

In accordance with the present invention, a door lock of the type described is provided which has a transverse hole through the bottom end portion of the pin for alignment with a generally vertically elongated slot hole in the outer wall of the lower sleeve on the bracket. A security member must be extended through the holes in both the lower sleeve and the pin so as to preclude upward displacement of the pin without breaking or removing the security member.

The capability of double locking a door is accomplished by sizing the holes in the cam member bottom flange and hasp upper wall for receiving a rigid wire loop of a padlock or the like. The cam member bottom flange has a flat horizontal portion positioned above a flat horizontal upper wall portion on the hasp. Aligned holes are provided in the flat horizontal portions of the cam member bottom flange and hasp upper wall on the opposite side of the lever-to-hasp connection from the bracket sleeves. The aligned holes have a minimum dimension of approximately 1.6 cm for receiving a padlock rigid wire having a diameter of approximately 1.3 cm. The hole in the cam member bottom flange is preferably elongated in a direction extending along the hasp or generally perpendicular to the pivot axis of the cam member to facilitate extension of a padlock wire loop through both holes despite some misalignment thereof.

In the preferred arrangement, the hole in the pin does not extend below the bottom edge of the lower sleeve outer wall or does not extend therebelow a sufficient distance to allow insertion of a shipper's seal or other security member through the pin slot below the bottom edge of the lower sleeve outer wall. With this arrangement, the only way of extending a security member, e.g., a rigid wire loop of a padlock or a shipper's seal, through the hole in the pin is to extend such security member through the hole in the outer wall of the lower sleeve. With the security member extending through both the outer wall of the lower sleeve and the bottom end portion of the pin, upward displacement of the pin is not possible without first removing or breaking the security member.

In a preferred arrangement, the hole in the outer wall of the lower sleeve on the bracket is a generally vertically elongated slot and has a width substantially the same as the diameter of the circular hole in the bottom end portion of the pin. This circular hole preferably has a diameter of approximately 1.6 cm or so. This allows a loop of rigid wire having a diameter of around 1.3 cm to freely pass through the hole and slot.

The outer wall of the lower sleeve has an inner surface defining one surface of the lower opening and is spaced a predetermined distance from an opposite surface of the bracket. The pin includes a lower pin portion having a thickness substantially less than the foregoing predetermined distance and the lower pin sidewall is located closely adjacent the inner surface of the lower sleeve outer wall. This provides a free space between the reduced thickness lower pin sidewall and the opposite surface of the lower opening for allowing free extension and manipulation of a security member therethrough.

The vertically elongated slot preferably has a vertical length which is at least two times the width of such slot. This arrangement allows insertion of a security member through the bracket slot and pin hole while still allowing for improper fits or misalignment.

The principal object of the present invention is the provision of an improved door lock having added security measures to prevent unauthorized opening thereof.

An additional object of the invention is to provide such an improved door lock which can be double locked with the use of separate padlocks or the like if so desired.

It is also an object of the present invention to provide an improved door lock which cannot be opened without first breaking shipper's seals or removing associated padlocks therefrom.

It is another object of the invention to provide an improved door lock having an improved shape for a lock pin, and for the bracket and hasp openings which receive the pin.

A further object of the invention is to accomplish the foregoing objectives with a minimum of expense and modification to existing door locks.

Still other objects and advantages for the invention will become apparent to those skilled in the art upon a reading and understanding of the following specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF A PREFERRED EMBODIMENT

Figure 1:
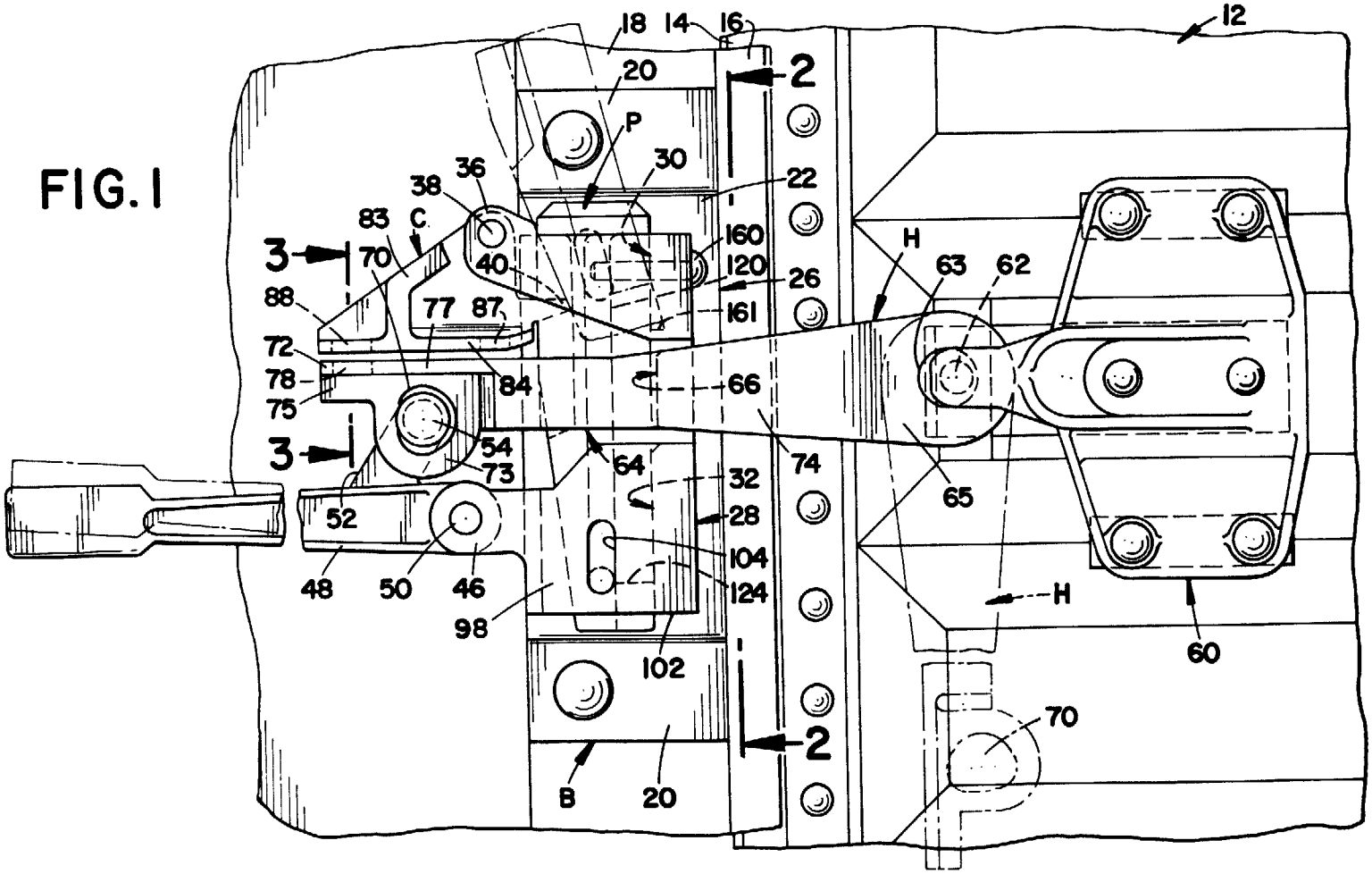
FIG. 1 is a front plan view of a door lock constructed in accordance with the present application.

With reference to the drawings, wherein the showings are for purposes of illustrating a preferred embodiment of the invention only and not for purposes of limiting same, FIG. 1 shows a door 12 which is mounted for sliding movement in a known manner from left-to-right and from right-to-left. A front edge portion 14 of door 12 cooperates with a sealing lip 16 on a door frame member 18 in the closed position of door 12. It will be recognized that frame member 18 may be part of a fixed door jamb or that it may be part of a secured auxiliary door of a double sliding door arrangement.

Figure 2:
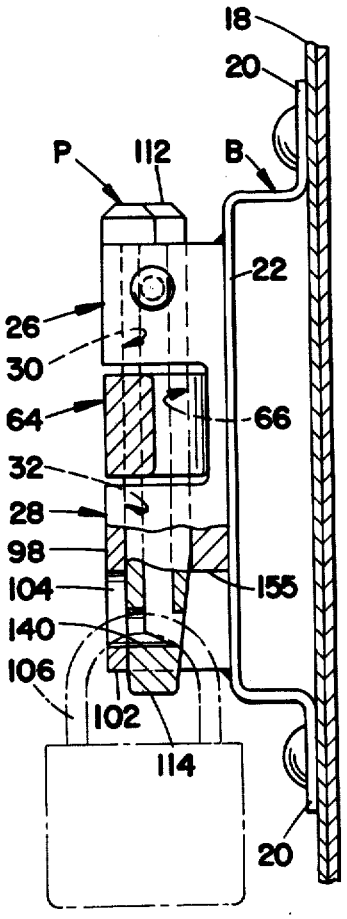
FIG. 2 is a cross-sectional elevational view taken generally along lines 2—2 of FIG. 1, and with portions cut-away and in section for clarity of illustration.

As shown in FIGS. 1 and 2, a bracket B includes a mounting portion having opposite mounting flanges 20 suitably secured to frame member 18 and a central flat plate portion 22 which is spaced outwardly from mounting flanges 20 and from frame member 18. A sleeve defining member is welded to flat plate portion 22 for providing vertically spaced upper and lower sleeves 26,28 having substantially vertically aligned upper and lower openings 30,32 extending therethrough. Sleeves 26,28 have flat outer surfaces lying substantially in a common vertical plane.

Attached to bracket B about axis 38 are spaced ears 36 adjacent upper sleeve 26 for pivotally supporting a cam member C and thereby facilitate swinging movement about axis 38. Cam member C includes a forward projection 40, and swings about axis 38 for movement of projection 40 generally toward and away from sleeve 26. Also attached to the bracket about axis 50 are ears 46 adjacent lower sleeve 28 to pivotally support a lever 48 for pivotal movement about axis 50. Lever 48 has a short arm 52 extending upwardly therefrom and a projection 54 extends normally or outwardly from arm 52 in a direction outwardly of the plane of the paper in FIG. 1.

Figure 7:
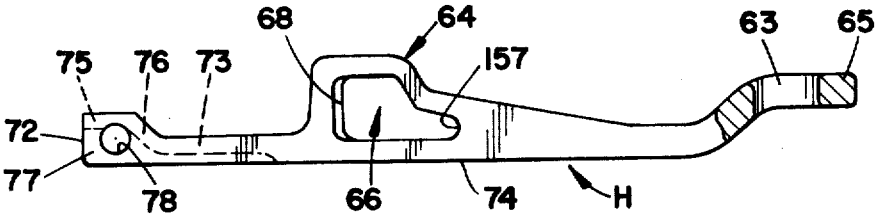
FIG. 7 is a top plan view of a hasp used in the door lock of FIG. 1.

A hasp mounting plate 60 is suitably secured to door 12 and has a pin 62 loosely received through a suitable hole 63 in one offset end portion 65 of a hasp H so that the hasp can freely swing between the solid line and phantom line positions of FIG. 1 and so that the hasp can also swing in directions both inwardly and outwardly of the plane of the paper. As best shown in FIG. 7, hasp H has a socket portion 64 with a hasp opening 66 therethrough. An upper portion 68 of one side of opening 66 is inclined inwardly in a direction from the top toward the bottom of hasp H for cooperation with a cam surface on a pin. Hasp H has a transverse hole 70 through the end portion thereof close to hasp free end 72 for freely receiving projection 54 on lever 48. Hasp H is positionable in a securing position with socket portion 64 thereof received between upper and lower sleeves 26,28.

Projection 54 on arm 52 of lever 48 and transverse hole 70 define cooperating means for moving hasp H in response to swinging movement of lever 48 to substantially vertically align hasp opening 66 with upper and lower sleeve openings 30,32 and to effect initial opening or final closing movement of door 12. In the solid line securing position of hasp H shown in FIG. 1, the outer surface of hasp sleeve portion 64 lies substantially in a common plane with the outer surfaces of upper and lower sleeves 26,28. Hasp H is swingable about pin 62 in a direction out of the plane of the paper to displace hasp socket 64 from between upper and lower sleeves 26,28 and to remove hasp opening 70 from lever projection 54 so that lever 48 can swing downwardly about hinge pin 62 to the phantom line position of FIG. 1.

Figure 8:
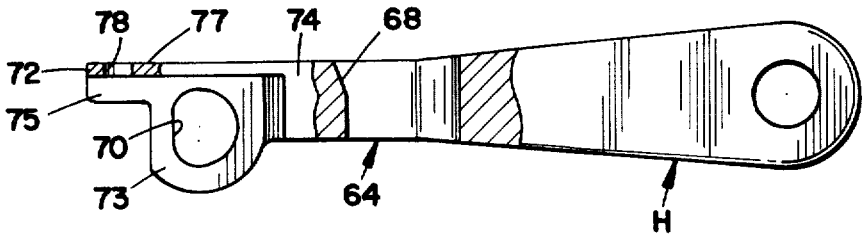
FIG. 8 is a side elevational view of the hasp of FIG. 7.

As shown in FIGS. 7 and 8, hasp H has a substantially plane vertical flange portion 73 which is offset inwardly from substantially plane hasp outer surface 74 and through which hasp opening 70 is formed. A substantially plane vertical stiffening flange 75 is offset rearwardly away from hasp outer surface 74 and toward hasp free end 72 from flange portion 73, and is integrally connected therewith by an inclined flange portion 76. Stiffening flange 75 has a height and width substantially less than flange portion 73, and extends generally parallel to flange portion 73 and to hasp outer surface 74. A substantially flat horizontal hasp upper wall 77 extends in perpendicular cantilever fashion from the upper edges of flange portions 73,75 and 76 toward hasp outer surface 74, and has its outer free edge lying in substantially the same plane as hasp outer surface 74. A substantially circular vertical hole 78 having a diameter of approximately 1.6 cm is formed through hasp upper wall 77 inwardly from hasp free end 72 in general alignment with stiffening flange 75, and on the opposite side of hasp opening 70 from hasp socket 64.

Figure 6:
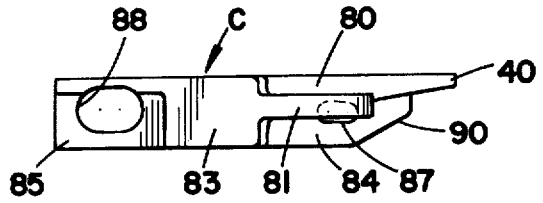
FIG. 6 is a top plan view of the cam member of FIG. 4.
Figure 4:
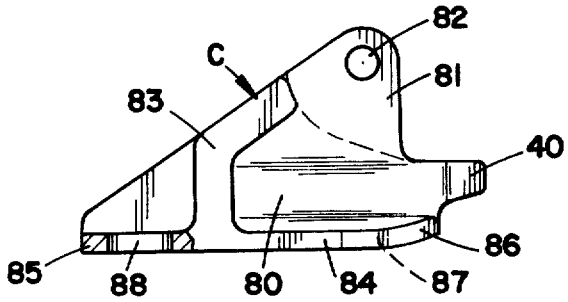
FIG. 4 is a side elevational view of a cam member used in the door lock of FIG. 1.
Figure 5:
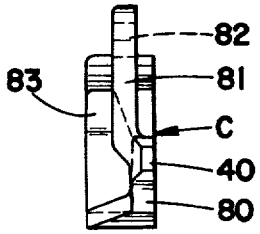
FIG. 5 is an end elevational view of the cam member in FIG. 4 looking at the right end of FIG. 4.

Cam member C includes a generally vertical flat plane portion 80 having an offset upper mounting portion 81 with a transverse hole 82 therethrough for receiving a suitable pin to pivotally mount cam member C on axis 38 to ears 36 on bracket B in FIG. 1. Cam member C includes a generally upright stiffening spine 83 having a substantially vertical lower portion and an inclined upper portion which extends from the vertical portion toward hole 82. Spine 83 has a generally rectangular cross-sectional shape and is of substantial thickness for strength. Cam member mounting portion 81 is approximately centered relative to spine 83, although it is located closer to the rear surface of spine 83 than to the front surface thereof as shown in FIG. 5. Front and rear cam member bottom flanges 84,85 extend substantially horizontal and perpendicular to plate portion 80 at the bottom edge thereof, and are located on opposite sides of spine 83. A forward portion 86 of front flange 84 is curved upwardly for providing clearance with hasp upper wall 77 when cam member C is pivoted clockwise in FIG. 1. The remainder of bottom flange 84, and of bottom flange 85, is substantially flat and horizontal. Vertical hole 87 in forward bottom flange 84 is an elongated slot generally corresponding to the hole in the cam member arcuate bottom flange in aforementioned U.S. Pat. No. 3,279,839. Cam slot 87 has a length of approximately 1.6 cm generally parallel to the length of flange 84, and a width of approximately 0.95 cm generally parallel to the axis of cam member mounting hole 82. Cam member rear bottom flange 85 has a hole 88 in the form of a slot having a length from left-to-right in FIG. 4 of approximately 2.22 cm, and a width generally perpendicular to its length of approximately 1.6 cm. With the parts assembled as in FIG. 1, cam member bottom flange slots 87,88 are elongated along or parallel to the length of hasp H. Cam member front projection 40 is defined by a shaped front portion of plate portion 80 and bottom flange 84 has its outer forward edge portion tapered as indicated at 90 in FIG. 6 so that narrow front projection 40 will freely extend into upper sleeve 26 without interference from bottom flange 84. Tapered front edge 90 and the forwardmost portion of bottom flange 84 are spaced a substantial distance toward spine 83 from the terminal end of projection 40.

Lower sleeve 28 on bracket B has a substantially flat outer wall 98 which includes a substantially horizontal outer wall bottom edge 102. A generally vertical hole slot 104 extends through lower sleeve outer wall 98, with the bottom of such slot 104 being approximately 0.96 cm above bottom edge 102 thereof. Hole slot 104 has a width of approximately 1.6 cm for freely receiving a padlock wire rod designated as 106 in FIG. 4 and which has a wire diameter of approximately 1.3 cm. Slot 104 has a length of approximately 4.13 cm.

Figure 14:
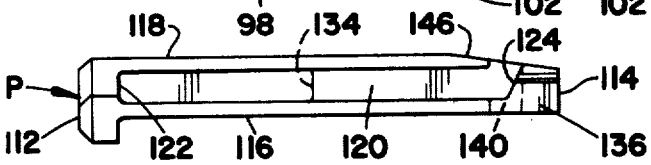
FIG. 14 is a plan view of FIG. 12 showing one side of the lock pin; and, FIG. 15 is an end elevational view looking at the right hand or bottom end of the pin in FIG. 12.
Figure 15:
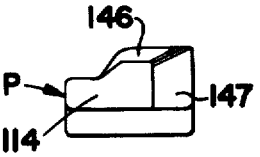
Figure 12:
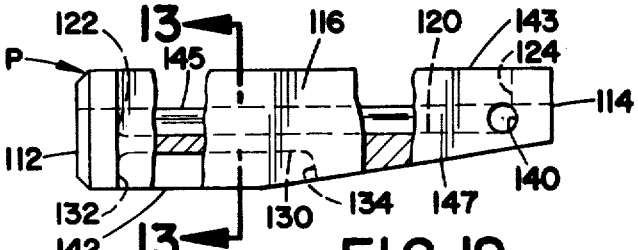
FIG. 12 is a front elevational view of a lock pin used in the lock of FIG. 1.

FIGS. 12–15 show an elongated lock pin P having top and bottom ends 112,114. Lock pin P includes front and rear sidewalls 116,118, with a vertically elongated first groove 120 defined between pin front and rear sidewalls 116,118. First groove 120 terminates at its top end 122 at the underside of pin top end 112 and at its bottom at an abutment 124. An opposite second groove 130 is substantially shorter than first groove 120 and terminates at its top end 132 at the underside of pin top end 112 and at its lower end at an upwardly facing stop shoulder 134 spaced substantially above first groove stop shoulder 124. As shown in FIG. 14, only front sidewall 116 of lock pin P extends below first groove stop shoulder 124 to define a thickened lower pin sidewall portion 136 extending below first stop shoulder 124.

Figure 13:
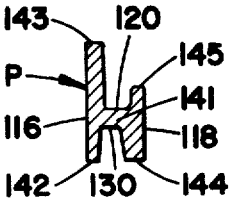
FIG. 13 is a cross-sectional elevational view taken generally along lines 13—13 of FIG. 12.

A generally circular hole 140 having a diameter of approximately 1.6 cm extends through the lower portion of pin P generally perpendicular to front wall 116 adjacent thickened lower pin portion 136. The center of hole 140 is spaced approximately 2.54 cm above the bottom end of the pin. A web 141 spaces front and rear pin walls 116,118 as shown in FIG. 13, and has grooves 120,130 defined on opposite sides thereof. Front wall 116 has flanges 142,143 extending in opposite directions from web 141, while rear wall 118 has similar flanges 144,145. Front flange 143 extends outwardly from web 141 a substantially greater distance than corresponding rear flange 145. By way of example, front flange 143 extends outwardly from web 141 approximately 3.25 cm while corresponding opposite rear flange 145 extends approximately 1.43 cm fron web 141. Flanges 142,144 each extend approximately 1.67 cm from web 141 which has a thickness parallel to front and rear walls 116,118 of approximately 0.8 cm. A lower rear edge portion 146 of pin P slopes inwardly toward pin bottom 114. Flanges 143,145 have substantially vertical straight longitudinal edges, while the opposite edge of pin P has a cam surface which slopes inwardly from the area of short groove bottom end 134 to pin bottom end 114.

Figure 11:
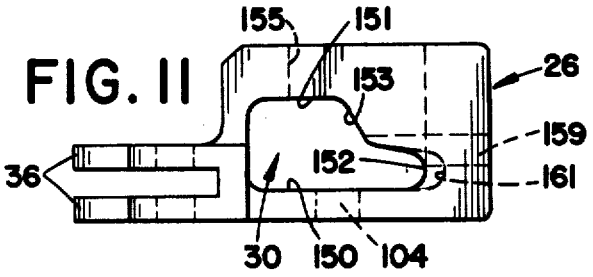
FIG. 11 is a top plan view of the bracket of FIG. 9.
Figure 9:
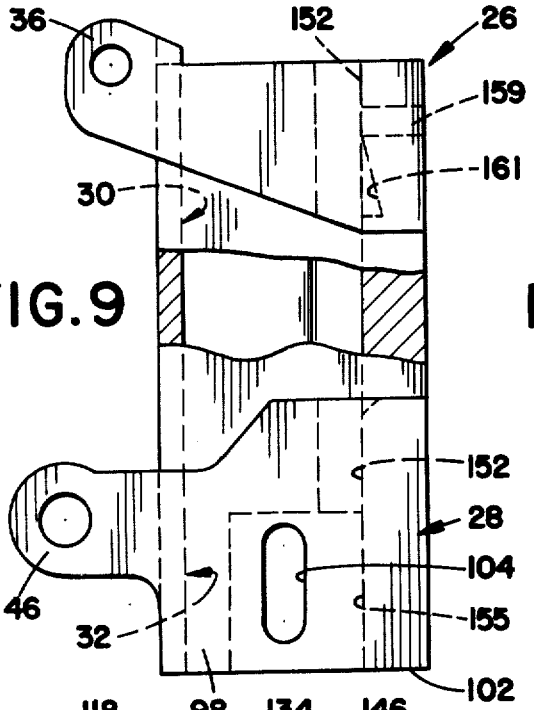
FIG. 9 is a front elevational view of a bracket used in the door lock of FIG. 1.
Figure 10:
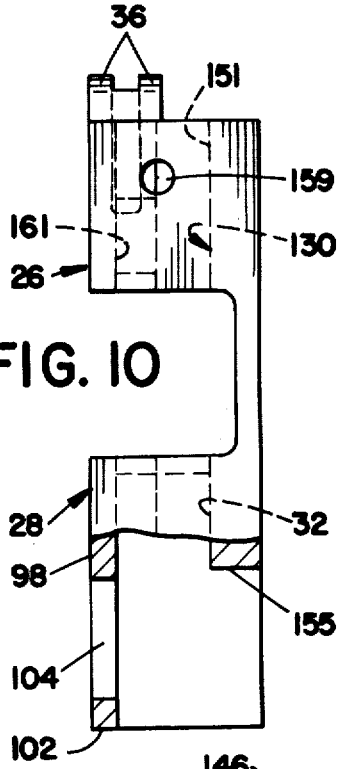
FIG. 10 is an end elevational view of the bracket looking at the right end of FIG. 8.

As shown in FIG. 11, upper sleeve vertical pin receiving opening 30 has a front portion 150 of substantially greater width than rear portion 151 thereof due to outwardly extending longitudinal front groove 152. An inclined portion 153 connects groove 152 with rear portion 151. Opening 30 has a depth front-to-back 150,151 of approximately 3.17 cm. The width of front portion 150 is approximately 6.2 cm while the width of rear portion 151 is approximately 3.34 cm. The width of inclined portion 153 parallel to front and rear portions 150,151 from rear portion 151 to groove 152 is approximately 0.95 cm. The depth of groove 152 is approximately 1.35 cm. Lower opening 32 in lower sleeve 28 is shaped substantially the same as upper opening 30. The rear of lower sleeve 28 is cut-away opposite slot 104 as indicated at 155 to provide clearance for inserting a padlock wire loop 106 as shown in FIG. 2. Thus, the distance from the inner surface of lower sleeve outer wall 98 to the surface of mounting plate 22 within sleeve cut-away portion 155 in FIG. 2 is substantially greater than the front-to-back thickness of the lower portion of pin P. The shape of opening 66 in hasp H corresponds to openings 30,32 in sleeves 26,28 except that it is slightly smaller. Thus, hasp opening 66 has an outwardly extending longitudinal front groove 157 which is aligned with grooves 152 of sleeve openings 30,32 in the securing position of hasp H.

Pin P has a generally I or H-shaped cross-section as shown in FIG. 13, and pin front flange 143 is received in aligned grooves 152,157 in the sleeve openings and the hasp opening. Rear pin wall 118 is received along the rear portions of the openings. The distance from the bottom or right hand edge of groove 152 in FIG. 11 to the center of slot 104 is approximately the same as the distance from the vertical edge of pin flange 143 to the center of pin hole 140. Providing a wider pin front wall 116 than a rear wall 118 saves material while maintaining pin strength and insuring sufficient width of the front wall for hole 140 without sacrificing strength.

Lock pin P is assembled to bracket B at the factory simply by positioning lock pin P through upper and lower openings 30,32 in upper and lower sleeves 26,28. The right sidewall of upper sleeve 26 has a suitable hole 159 therethrough for receiving a retaining pin 160 which is then welded or otherwise fixed to upper sleeve 26 against removal therefrom. Retaining pin 160 projects into first groove 120 in lock pin P for preventing complete upward displacement of lock pin P from upper opening 30. The distance from stop shoulder 124 of lock pin first groove 120 to lock pin bottom end 114 is preferably slightly less than the distance from the bottom of retaining pin 160 to the bottom edge of upper sleeve 26. This allows lock pin P to be pulled upwardly until stop shoulder 124 strikes retaining pin 160 and in that position lock pin bottom end 114 does not extend below the bottom edge of upper sleeve 26 so that hasp H can freely move into and out of a position between upper and lower sleeves 26,28. Thus, lock pin P is permanently assembled to bracket B so it cannot be lost. An inwardly inclined recess 161 in groove 152 of upper opening 30 receives the lower corner of pin P to hold pin P in the upper slightly inclined phantom line position of FIG. 1.

The distance from second stop shoulder 134 of second groove 130 in lock pin P to lock pin bottom end 114 is preferably substantially greater than the distance from the underside of cam member projection 40 to the upper surface of hasp H. With this arrangement, even if a security member is removed or not positioned through lower sleeve hole 104 and pin hole 140, upward movement of pin P will be limited by having second stop shoulder 134 strike the underside of cam member projection 40. In this position of lock pin P, the lock pin will still extend through upper opening 30 and at least through a substantial portion of hasp opening 66 for preventing displacement of hasp H from its securing position between upper and lower sleeves 26,28. Cam member C can be pivoted to the left in FIG. 1 for allowing second stop shoulder 134 to move upwardly past cam member projection 40.

Once hasp H is properly located between upper and lower sleeves 26,28, cam member C can be pivoted to the left in FIG. 1 for displacing cam member projection 40 and this will allow lock pin P to fall through all of openings 30,32 and 66 to its locking position wherein pin hole 140 is aligned with lower sleeve outer wall slot 104. In this locking position of the lock pin, pin hole 140 is preferably not spaced below bottom edge 102 of lower sleeve outer wall 98. This prevents positioning of a security member only through pin hole 140. If lock pin P is capable of moving downwardly far enough so that pin hole 140 will clear bottom edge 102, the clearance is preferably insufficient to allow extension of a shipper's seal or other security member only through lock pin hole 140 without also being extended through slot 104 in lower sleeve outer wall 98.

Figure 3:
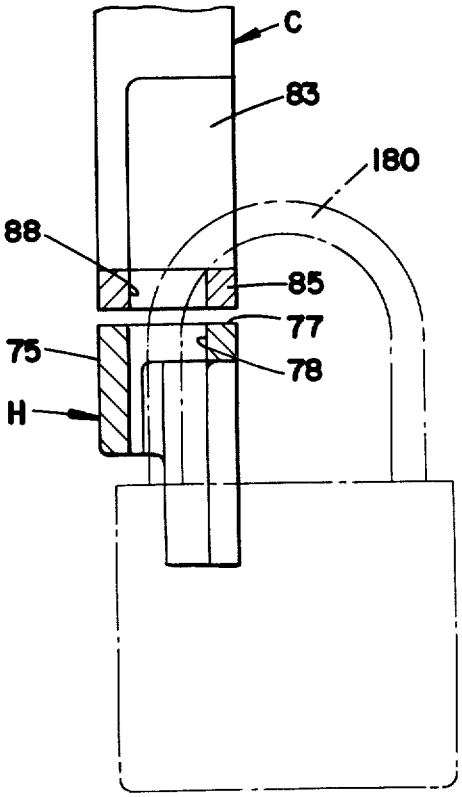
FIG. 3 is a partial cross-sectional elevational view taken generally along lines 3—3 of FIG. 1.

With hasp H in its securing position between upper and lower sleeves 26,28 in the manner shown in FIG. 1, holes 78,88 in cam member bottom flange 85 and hasp upper wall portion 77 are substantially vertically aligned for receiving another security member in the form of a shipper's seal or a rigid wire loop of a padlock. FIG. 3 shows a rigid wire loop 180 of another padlock extending through such holes, with the wire having a diameter of approximately 1.3 cm. The location of hasp H may vary slightly when door 12 is completely closed by operation of lever 48 and cam member C may be pivoted somewhat for properly aligning slot hole 88 in bottom flange 85 thereof with hole 78 in hasp upper wall portion 77. Cam member bottom flange hole slot 88 is elongate along the length of hasp H and, together with hasp hole 78, is located on the opposite side of the lever-to-hasp cooperating means 54,70 from bracket B and sleeves 26,28.

Although the invention has been shown and described with respect to a preferred embodiment, it is obvious that modifications and alterations will occur to others upon a reading and understanding of this specification. It is intended to include all such modifications and alterations insofar as they come within the scope of the claims or the equivalents thereof.

Having thus described the invention, it is now claimed:

1. In a door lock of the type including a bracket having vertically-spaced upper and lower sleeves with substantially vertically aligned upper and lower pin receiving openings therethrough, a movable hasp having a hasp sleeve portion with a hasp opening therethrough, said hasp being movable to a securing position in which said sleeve portion thereof is located between said upper and lower sleeves with said hasp opening substantially vertically aligned with said upper and lower openings, a lever pivotally mounted on said bracket, cooperating means between said lever and hasp for moving said hasp in response to swinging movement of said lever to align said hasp opening with said upper and lower openings and to effect initial opening or final closing movement of a door to which said hasp is connected, said lower sleeve having an outer wall with a bottom edge, a pin receivable in said openings to define a pin locking position for securing said hasp against movement, said pin having a bottom end, a hole through said pin adjacent said bottom end thereof, said pin in said locking position having said hole therein located adjacent said bottom edge of said lower sleeve outer wall for receiving a security member to inhibit upward movement of said pin through said lower opening, a cam member pivotally mounted on said bracket adjacent said upper sleeve for movement between pin blocking and pin releasing positions, said cam member in said pin blocking position cooperating with said pin for preventing upward movement of said pin out of said hasp opening and in said pin releasing position providing free upward movement of said pin out of said hasp opening, said cam member having a lower flange and said hasp having an upper wall portion aligned with said flange, and said lower flange and said hasp upper wall portion having substantially vertical holes therethrough for receiving a security member to lock said cam member in said pin blocking position, the improvement comprising: said sleeves and said holes in said cam member lower flange and hasp upper wall portion being positioned on opposite sides of said cooperating means between said lever and hasp.

2. The improvement as defined in claim 1 wherein said hole in said lower flange of said cam member is elongated in a direction generally perpendicular to the pivot axis of said cam member and said hole in said hasp is substantially circular.

3. The improvement as defined in claim 1 wherein said holes in said cam member lower flange and in said hasp upper wall portion have minimum dimensions of approximately 1.6 cm.

4. In a door lock of the type including a bracket having vertically-spaced upper and lower sleeves with substantially vertically aligned upper and lower pin receiving openings therethrough, a movable hasp having a hasp sleeve portion with a hasp opening therethrough, said hasp being movable to a securing position in which said sleeve portion thereof is located between said upper and lower sleeves with said hasp opening substantially vertically aligned with said upper and lower openings, a lever pivotally mounted on said bracket, cooperating means between said lever and hasp for moving said hasp in response to swinging movement of said lever to align said hasp opening with said upper and lower openings and to effect initial opening or final closing movement of a door to which said hasp is connected, said lower sleeve having an outer wall with a bottom edge, a pin receivable in said openings to define a pin locking position for securing said hasp against movement, said pin having a bottom end, a hole through said pin adjacent said bottom end thereof, said pin in said locking position having said hole therein located adjacent said bottom edge of said lower sleeve outer wall for receiving a security member to inhibit upward movement of said pin through said lower opening, the improvement comprising: said pin in said locking position thereof having said hole therein spaced above said bottom edge of said lower sleeve outer wall and said lower sleeve outer wall having a hole therein aligned with said hole in said pin, at least one of said holes in said pin and outer wall being a generally vertically elongated slot, a cam member pivotally mounted on said bracket adjacent said upper sleeve for movement between pin blocking and pin releasing positions, said cam member in said pin blocking position cooperating with said pin for preventing upward movement of said pin out of said hasp opening and said cam member in said pin releasing position providing free upward movement of said pin out of said hasp opening, said cam member having a lower flange and said hasp having an upper generally horizontal hasp wall positioned closely below said cam member flange when said hasp is in said securing position, said cam member flange and said hasp wall having substantially vertical holes therethrough which are aligned in said pin blocking position of said cam member and said securing position of said hasp for receiving a security member, and said cooperating means between said lever and hasp being located intermediate said sleeves and said holes in said cam member flange and hasp wall.

5. The improvement as defined in claim 4 wherein said cam member flange and said hasp wall are substantially flat in the areas thereof having said vertical holes therein and such areas extend substantially parallel to one another when said cam member is in said pin blocking position and said hasp is in said securing position.

6. In a door lock of the type including a bracket having vertically-spaced upper and lower sleeves with substantially vertically aligned upper and lower pin receiving openings therethrough, a movable hasp having a hasp sleeve portion with a hasp opening therethrough, said hasp being movable to a securing position in which said sleeve portion thereof is located between said upper and lower sleeves with said hasp opening substantially vertically aligned with said upper and lower openings, a lever pivotally mounted on said bracket, cooperating means between said lever and hasp for moving said hasp in response to swinging movement of said lever to align said hasp opening with said upper and lower openings and to effect initial opening or final closing movement of a door to which said hasp is connected, said lower sleeve having an outer wall with a bottom edge, a pin receivable in said openings to define a pin locking position for securing said hasp against movement, said pin having a bottom end, a hole through said pin adjacent said bottom end thereof, said pin in said locking position having said hole therein located adjacent said bottom edge of said lower sleeve outer wall for receiving a security member to inhibit upward movement of said pin through said lower opening, the improvement comprising: said pin in said locking position thereof having said hole therein spaced above said bottom edge of said lower sleeve outer wall and said lower sleeve outer wall having a hole therein aligned with said hole in said pin, at least one of said holes in said pin and outer wall being a generally vertically elongated slot, said pin having front and rear pin walls spaced by a web providing opposite longitudinal pin grooves, said pin front wall having a width substantially greater than the width of said rear pin wall such that at least one longitudinal edge of said pin front wall is spaced outwardly from said web a distance substantially greater than the corresponding longitudinal edge on said pin rear wall, and said openings in said hasp and sleeves being substantially wider at the front portions thereof than at the rear portions thereof and being shaped for providing longitudinally extending substantially aligned opening grooves receiving the portion of said pin front wall on which said one longitudinal edge is located.

7. The improvement as defined in claim 1 wherein said slot is in said outer wall of said lower sleeve and said hole in said pin is substantially circular and has a diameter which is substantially the same as the width of said slot.

* * * * *